US010301571B2

(12) United States Patent
Bima

(10) Patent No.: US 10,301,571 B2
(45) Date of Patent: May 28, 2019

(54) LUBRICANT VISCOSITY MODIFICATION SYSTEM

(71) Applicant: DENSO International America, Inc., Southfield, MI (US)

(72) Inventor: Michael Bima, Milford, MI (US)

(73) Assignee: DENSO International America, Inc., Southfield, MI (US)

( * ) Notice: Subject to any disclaimer, the term of this patent is extended or adjusted under 35 U.S.C. 154(b) by 352 days.

(21) Appl. No.: 15/238,309

(22) Filed: Aug. 16, 2016

(65) Prior Publication Data

US 2018/0051229 A1 Feb. 22, 2018

(51) Int. Cl.

| | |
|---|---|
| ***B01J 19/08*** | (2006.01) |
| ***C10M 125/02*** | (2006.01) |
| ***C10M 125/04*** | (2006.01) |
| ***C10M 125/10*** | (2006.01) |
| ***C10M 177/00*** | (2006.01) |

(52) U.S. Cl.

CPC ..... *C10M 177/00* (2013.01); *B01J 19/087* (2013.01); *C10M 125/02* (2013.01); *C10M 125/04* (2013.01); *C10M 125/10* (2013.01); *B01J 2219/0803* (2013.01); *B01J 2219/0877* (2013.01); *C10M 2201/041* (2013.01); *C10M 2201/05* (2013.01); *C10M 2201/062* (2013.01); *C10N 2220/082* (2013.01); *C10N 2240/04* (2013.01); *C10N 2240/08* (2013.01); *C10N 2240/10* (2013.01); *C10N 2270/00* (2013.01)

(58) Field of Classification Search

CPC ..... B01J 2219/0803; B01J 2219/0877; C10N 2220/082; C10N 2240/04; C10N 2240/08; C10N 2240/10; C10N 2270/00; C10M 2201/05; C10M 2201/041; C10M 2201/062

USPC ..... 508/200

See application file for complete search history.

(56) References Cited

U.S. PATENT DOCUMENTS

| | | | | |
|---|---|---|---|---|
| 6,398,509 | B1 * | 6/2002 | Okazaki | B23Q 1/70 184/6.14 |
| 2004/0040789 | A1 * | 3/2004 | Rake | F16N 29/02 184/6.23 |
| 2009/0053268 | A1 * | 2/2009 | DePablo | A61K 8/92 424/401 |

* cited by examiner

*Primary Examiner* — Vishal V Vasisth

(74) *Attorney, Agent, or Firm* — Harness, Dickey & Pierce, P.L.C.

(57) ABSTRACT

A system for modifying viscosity of a lubricant. The system including a viscosity modification device configured to change viscosity of the lubricant between a first viscosity and a second viscosity. The second viscosity is lower than the first viscosity.

14 Claims, 4 Drawing Sheets

LUBRICANT VISCOSITY MODIFICATION SYSTEM

FIELD

The present disclosure relates to a system for modifying viscosity of a lubricant.

BACKGROUND

This section provides background information related to the present disclosure, which is not necessarily prior art.

Lubricants are often used in mechanical systems to improve the efficiency thereof. While existing lubricants are suitable for their intended use, it would be desirable to improve their efficiency. The present teachings advantageously provide for systems and methods for improving lubricant efficiency, such as by changing lubricant viscosity based on operating conditions.

SUMMARY

This section provides a general summary of the disclosure, and is not a comprehensive disclosure of its full scope or all of its features.

The present teachings provide for a system for modifying viscosity of a lubricant. The system includes a viscosity modification device configured to change viscosity of the lubricant between a first viscosity and a second viscosity. The second viscosity is lower than the first viscosity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1A:
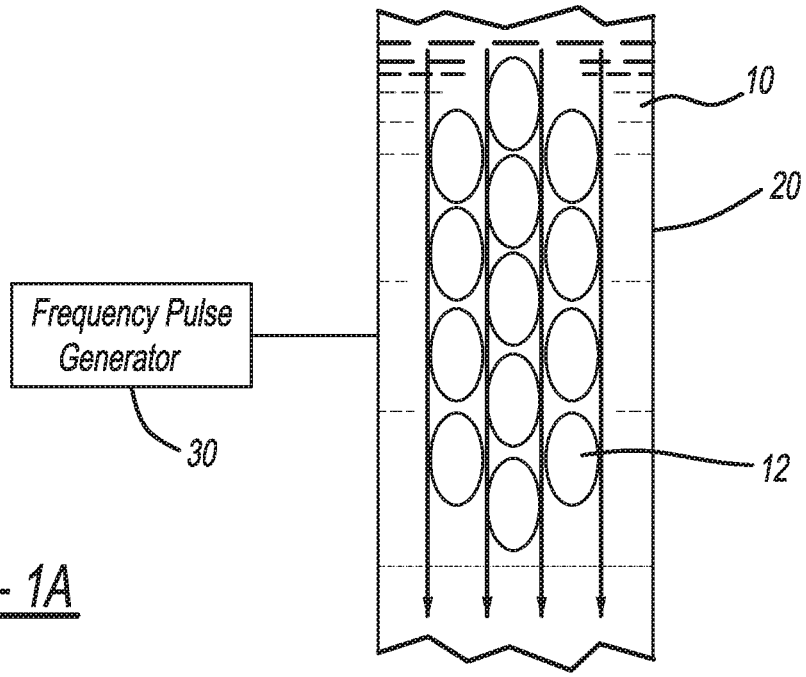
FIG. 1A illustrates a viscosity modification device according to the present teachings in the form of a frequency pulse generator at a high frequency to change viscosity of a lubricant to a first viscosity that is higher than a second viscosity.
Figure 1B:
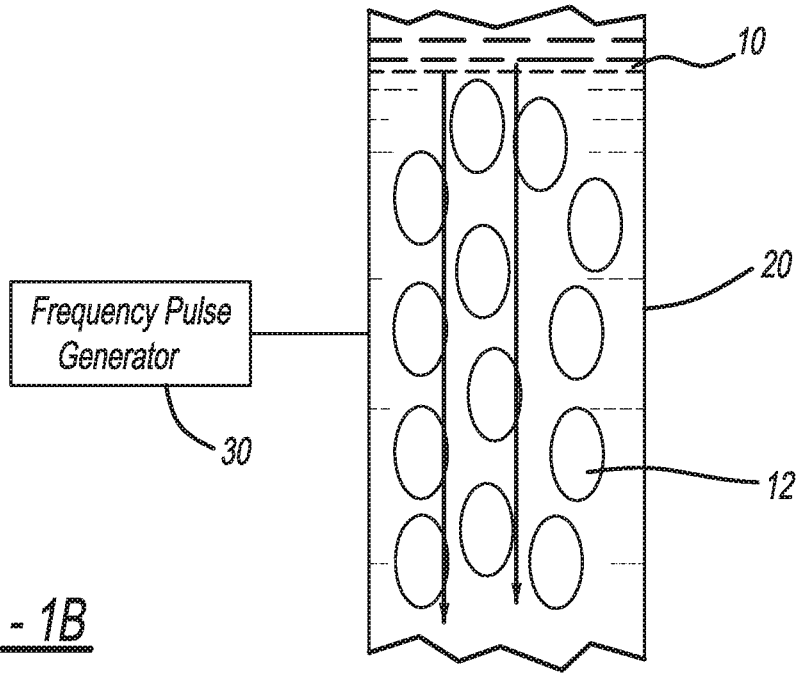
FIG. 1B illustrates the frequency pulse generator at a low frequency that is lower than the high frequency to provide the lubricant with a second viscosity that is lower than the first viscosity.

With initial reference to FIGS. 1A and 1B, a lubricant 10 including lubricant molecules 12 is illustrated. The lubricant 10 can be any suitable lubricant, such as, but not limited to, engine oil, transmission oil, engine cylinder lubricant, hydraulic fluid, etc. The lubricant 10 is illustrated as flowing through an exemplary conduit 20. The conduit 20 can be any suitable engine conduit, transmission conduit, etc.

FIGS. 1A and 1B further illustrate a viscosity modification device configured to modify viscosity of the lubricant 10. The viscosity modification device can be any suitable viscosity modification device, such as a frequency pulse generator 30. The frequency pulse generator 30 can be any suitable device configured to pass frequency pulses through the lubricant 10 at various different selected frequencies. For example, the frequency pulse generator 30 is configured to operate at a first frequency (illustrated in FIG. 1A) that is greater than a second frequency (illustrated in FIG. 1B). The first frequency can be above a natural resonance frequency of the lubricant 10, and the second frequency can be below the natural resonance frequency of the lubricant 10. When the frequency pulse generator 30 is configured to pass the first frequency through the lubricant 10 (FIG. 1A), the frequency pulse generated by the frequency pulse generator 30 compresses the lubricant molecules 12 together, which restricts movement of the lubricant molecules 12 and increases viscosity of the lubricant 10. When the frequency pulse generator 30 is configured to pass the second frequency through the lubricant 10 (FIG. 1B), the frequency pulse causes the lubricant molecules 12 to spread apart, which allows the lubricant molecules 12 to flow more freely and move loosely, thereby reducing viscosity of the lubricant 10. The frequency pulse generator 30 is thus advantageously configured to change viscosity of the lubricant 10 to optimize performance of the lubricant 10 for different operating conditions.

Figure 2A:
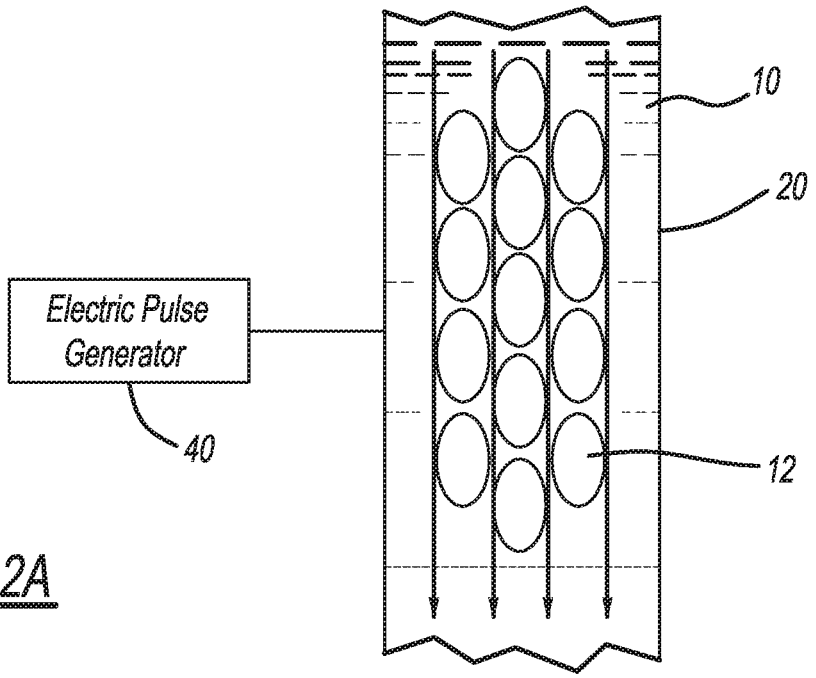
FIG. 2A illustrates a viscosity modification device according to the present teachings in the form of an electric pulse generator at a first voltage to provide a lubricant with a first viscosity.
Figure 2B:
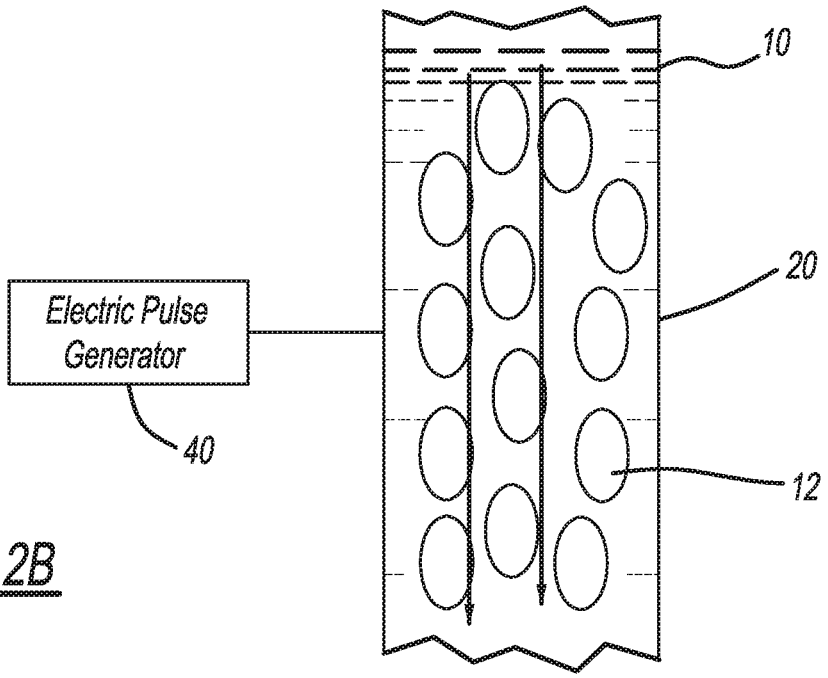
FIG. 2B illustrates the electric pulse generator of FIG. 2A at a second voltage that is lower than the first voltage to provide the lubricant with a second viscosity that is lower than the first viscosity.

FIGS. 2A and 2B illustrate a viscosity modification device according to the present teachings in the form of an electric pulse generator 40. The electric pulse generator 40 is configured to pass electrical pulses through the lubricant 10 to change the viscosity of the lubricant 10. For example and with reference to FIG. 2A, the electric pulse generator 40 is configured to pass an electric pulse through the lubricant 10 at a first voltage, which is greater than a second voltage, to provide the lubricant 10 with a first viscosity, which is greater than a second viscosity. The electric pulse of the first voltage compresses the lubricant molecules 12 together, which reduces the ability of the lubricant molecules 12 to move, and in turn increases viscosity of the lubricant 10. With reference to FIG. 2B, when the electric pulse generator 40 is configured to pass the electric pulse having the second voltage, which is less than the first voltage, the electric pulse causes the lubricant molecules 12 to spread apart, thereby allowing the lubricant molecules 12 to flow more freely and reducing viscosity of the lubricant 10 to the second viscosity, which is less than the first viscosity.

Figure 3A:
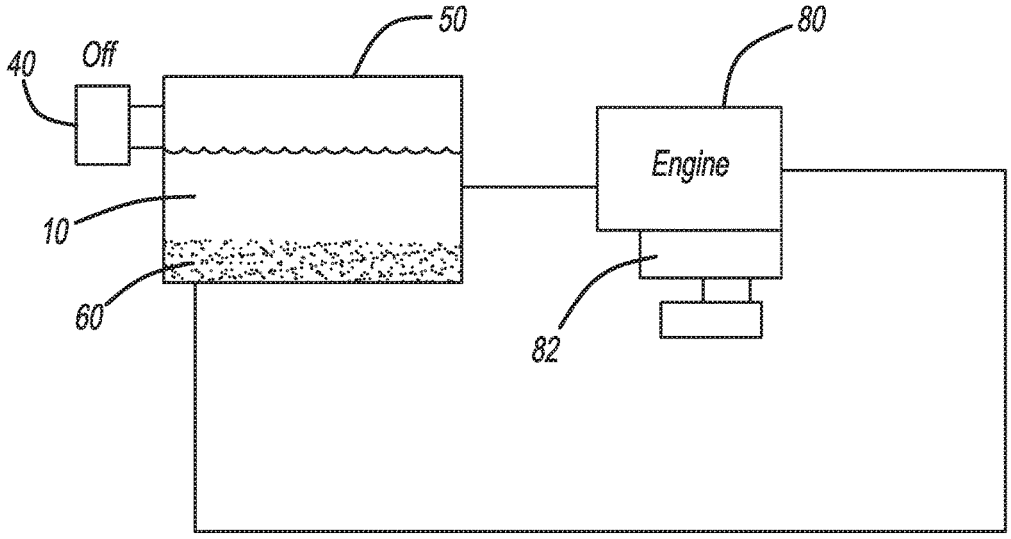
FIG. 3A illustrates a viscosity modification device according to the present teachings in the form of an electric pulse generator configured to change viscosity of a lubricant in the form of engine oil, the electric pulse generator is in an inactive state.
Figure 3B:
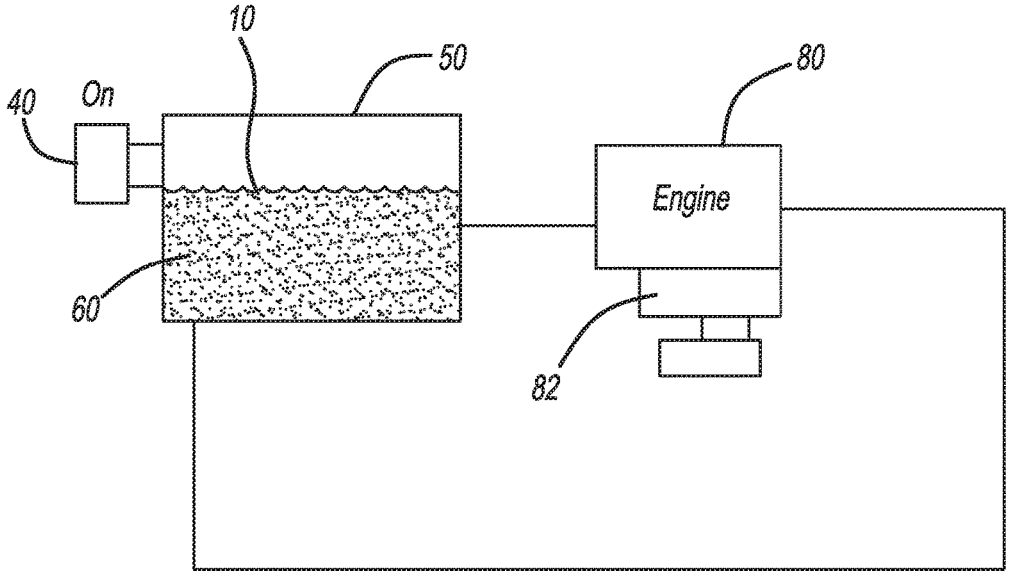
FIG. 3B illustrates the electric pulse generator of FIG. 3A in an active state in order to distribute nanoparticles throughout the lubricant and change viscosity of the lubricant.

With additional reference to FIGS. 3A and 3B, the electric pulse generator 40 is illustrated as being in cooperation with a lubricant storage device or storage tank 50. The lubricant 10 within the storage tank 50 includes a plurality of nanoparticles 60, which can be any suitable nanoparticles configured to enhance the effectiveness and performance of the lubricant 10. The nanoparticles 60 can be any suitable nanoparticles, such as one or more of the following: Cu; Mg; C; $Fe_3O_4$; CuO; and $TiO_2$. The electric pulse generator 40 is configured to pass an electric pulse of any suitable voltage through the lubricant 10 to change the viscosity thereof as described above, as well as distribute the nanoparticles 60 throughout the lubricant 10.

In the example of FIGS. 3A and 3B, the storage tank 50 is in cooperation with an engine 80, such as an automobile engine 80, to store lubricant 10 thereof, such as engine oil. Associated with the engine 80 is a lubricant pan 82, such as for collecting the lubricant 10 in the form of oil or coolant. The storage tank 50 can be included in any other suitable system to store lubricant thereof. For example, the storage tank 50 can be configured to store coolant or engine cylinder lubricant. Although FIGS. 3A and 3B illustrate the viscosity modification device in the form of the electric pulse generator 40, the electric pulse generator 40 can be replaced with the frequency pulse generator 30, or any other suitable viscosity modification device.

FIG. 3B illustrates the electric pulse generator 40 in an activated state to distribute the nanoparticles 60 throughout the storage tank 50. As explained above, the electric pulse generator 40 can be activated in order to pass a high voltage electric pulse through the lubricant 10 in order to increase the viscosity of the lubricant 10, and can be configured to pass a low voltage electric pulse through the lubricant 10 in order to decrease the viscosity thereof.

Figure 4:
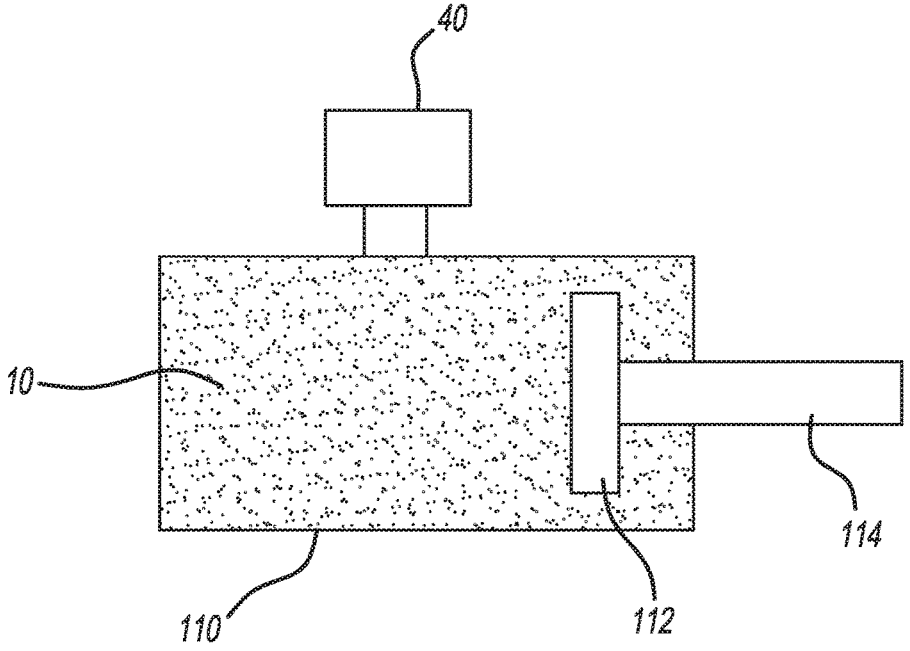
FIG. 4 illustrates a viscosity modification device according to the present teachings in the form of an electric pulse generator configured to change viscosity of lubricant of an engine cylinder.

FIG. 4 illustrates the electric pulse generator 40 coupled to a cylinder 110 of an engine containing lubricant 10 therein. A piston head 112 is moved within the cylinder 110 by a piston pin 114 coupled to an engine crankshaft. The electric pulse generator 40 is configured to change viscosity of the lubricant 10 by passing electric pulses through the lubricant 10 as described above. For example, the electric pulse generator 40 is configured to pass a high voltage electric pulse through the lubricant 10 to increase the viscosity of the lubricant 10 to a first viscosity, and pass an electric pulse of a second voltage that is lower than the first voltage in order to provide the lubricant 10 with a second viscosity that is lower than the first viscosity. Although FIG. 4 illustrates the viscosity modification device as the electric pulse generator 40, any suitable viscosity modification device can be associated with the cylinder 110 in order to change the viscosity of the lubricant 10 thereof. For example, the viscosity modification device can be the frequency pulse generator 30.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A system for modifying viscosity of a lubricant, the system comprising:

a viscosity modification device configured to change viscosity of the lubricant between a first viscosity and a second viscosity, the second viscosity is lower than the first viscosity;

wherein the viscosity modification device is one of a frequency pulse generator and an electric pulse generator;

wherein the frequency pulse generator is configured to generate a first frequency pulse and pass the first frequency pulse through the lubricant to provide the lubricant at the first viscosity and generate a second frequency pulse that is lower than the first frequency pulse and pass the second frequency pulse through the lubricant to provide the lubricant at the second viscosity; and wherein the electric pulse generator is configured to generate a first electric pulse and pass the first electric pulse through the lubricant to provide the lubricant at the first viscosity and generate a second electric pulse that has a lower voltage than the first electric pulse and pass the second electric pulse through the lubricant to provide the lubricant at the second viscosity.

2. The system of claim 1, wherein the lubricant includes engine oil, transmission oil, or engine cylinder lubricant.

3. The system of claim 1, wherein:

the first frequency pulse is above a natural resonance frequency of the lubricant; and the second frequency pulse is below the natural resonance frequency of the lubricant.

4. The system of claim 1, wherein at the first viscosity, molecules of the lubricant are, overall, closer together as compared to the second viscosity.

5. The system of claim 1, wherein the lubricant includes nanoparticles configured to increase effectiveness of the lubricant.

6. The system of claim 5, wherein the nanoparticles include at least one of the following: $Fe_3O_4$; CuO; and $TiO_2$.

7. The system of claim 1, wherein the viscosity modification device is connected to one of an engine cylinder, an oil tank, and a coolant tank to modify viscosity of the lubricant contained therein.

8. A system for modifying viscosity of a lubricant, the system comprising:

a viscosity modification device configured to change viscosity of the lubricant, the viscosity modification device is one of a frequency pulse generator and an electric pulse generator; and nanoparticles included with the lubricant, the nanoparticles configured to increase effectiveness of the lubricant;

wherein the viscosity modification device is in cooperation with one of an engine cylinder, an oil tank, and a coolant tank to modify viscosity of the lubricant contained therein;

wherein the frequency pulse generator is configured to generate a first frequency pulse that is above a natural resonance frequency of the lubricant and pass the first frequency pulse through the lubricant to provide the lubricant with a first viscosity and generate a second frequency pulse that is below the natural resonance frequency of the lubricant and pass the second frequency pulse through the lubricant to provide the lubricant with a second viscosity that is less than the first viscosity; and wherein the electric pulse generator is configured to generate a first electric pulse and pass the first electric pulse through the lubricant to provide the lubricant with the first viscosity, and generate a second electric pulse that has a lower voltage than the first electric pulse and pass the second electric pulse through the lubricant to provide the lubricant with the second viscosity that is lower than the first viscosity.

9. The system of claim 8, wherein the nanoparticles include at least one of the following: $Fe_3O_4$; CuO; and $TiO_2$.

10. The system of claim 8, wherein:

the viscosity modification device is configured to arrange molecules of the lubricant at a first distance apart to change viscosity of the lubricant to a first viscosity;

the viscosity modification device is configured to arrange molecules of the lubricant at a second distance apart to change viscosity of the lubricant to a second viscosity; and the first distance is less than the second distance, and the first viscosity is greater than the second viscosity.

11. A method for modifying viscosity of a lubricant, the method comprising;

raising viscosity of the lubricant to a first viscosity with a viscosity modification device that is one of a frequency pulse generator and an electric pulse generator; and lowering viscosity of the lubricant to a second viscosity, which is lower than the first viscosity, with the viscosity modification device;

wherein when the viscosity modification device is the frequency pulse generator, the method further comprises generating a first frequency pulse with the frequency pulse generator and passing the first frequency pulse through the lubricant to provide the lubricant at the first viscosity and generating a second frequency pulse with the frequency pulse generator that is lower than the first frequency pulse and passing the second frequency pulse through the lubricant to provide the lubricant at the second viscosity; and wherein when the viscosity modification device is the electric pulse generator, the method further comprises generating a first electric pulse and passing the first electric pulse through the lubricant to provide the lubricant at the first viscosity and generating a second electric pulse that has a lower voltage than the first electric pulse and passing the second electric pulse through the lubricant to provide the lubricant at the second viscosity.

12. The method of claim 11, further comprising distributing nanoparticles throughout the lubricant to increase effectiveness of the lubricant;

wherein the nanoparticles include at least one of the following: $Fe_3O_4$; CuO; and $TiO_2$.

13. The method of claim 12, further comprising distributing the nanoparticles throughout the lubricant with the viscosity modification device.

14. The method of claim 11, wherein the lubricant is engine oil, engine cylinder lubricant, or engine coolant.

* * * * *